US011804351B1

(12) United States Patent
Arciaga

(10) Patent No.: US 11,804,351 B1
(45) Date of Patent: Oct. 31, 2023

(54) HIGH BREAKING CAPACITY FUSE WITH FIRE-EXTINGUISHING PADS

(71) Applicant: Littelfuse, Inc., Chicago, IL (US)

(72) Inventor: Marko Arciaga, Betangas (PH)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/944,797

(22) Filed: Sep. 14, 2022

(51) Int. Cl.

| | |
|---|---|
| ***H01H 85/40*** | (2006.01) |
| ***H01H 85/04*** | (2006.01) |
| ***H01H 85/143*** | (2006.01) |
| ***H01H 85/38*** | (2006.01) |

(52) U.S. Cl.
CPC ..... *H01H 85/04* (2013.01); *H01H 85/143* (2013.01); *H01H 85/38* (2013.01); *H01H 85/40* (2013.01); *H01H 2085/388* (2013.01)

(58) Field of Classification Search
CPC ..... H01H 33/22; H01H 85/04; H01H 85/143; H01H 85/38; H01H 85/40; H01H 2085/383; H01H 2085/388
See application file for complete search history.

(56) References Cited

U.S. PATENT DOCUMENTS

2008/0122571 A1* 5/2008 Buchanan ..... H01H 85/18 337/276
2015/0002258 A1* 1/2015 Yoshida ..... H01H 85/38 337/273
2015/0294828 A1* 10/2015 Burge ..... H01H 85/38 337/274
2015/0340188 A1* 11/2015 Schmidt ..... H01H 85/05 337/186
2021/0090839 A1* 3/2021 Santos ..... H01H 85/046
2021/0391137 A1* 12/2021 Chen ..... H01H 69/02

FOREIGN PATENT DOCUMENTS

DE 1463002 A1 * 4/1969

OTHER PUBLICATIONS

Kaufmann, Otto. Translation of DE 1463002 A. (Year: 1969).*

* cited by examiner

*Primary Examiner* — Jacob R Crum
(74) *Attorney, Agent, or Firm* — KDW Firm PLLC

(57) ABSTRACT

A high breaking capacity fuse including an electrically insulating fuse body, a fusible element extending through the fuse body, an electrically conductive first terminal connected to a first end of the fusible element, an electrically conductive second terminal connected to a second end of the fusible element, and a first fire extinguishing pad and a second fire extinguishing disposed within the fuse body and sandwiching the fusible element therebetween, each of the first and second fire extinguishing pads formed of a polymeric substrate and a plurality of microcapsules embedded in the polymeric substrate, the plurality of microcapsules filled with an arc-quenching liquid.

12 Claims, 1 Drawing Sheet

HIGH BREAKING CAPACITY FUSE WITH FIRE-EXTINGUISHING PADS

FIELD OF THE DISCLOSURE

The present disclosure relates generally to the field of circuit protection devices and relates more particularly to a high breaking capacity fuse with arc-mitigating features.

FIELD OF THE DISCLOSURE

Fuses are commonly used as circuit protection devices and are typically installed between a source of electrical power and a component in a circuit that is to be protected. Generally, a fuse includes a fusible element disposed within a hollow, electrically insulating fuse body. Electrically conductive terminals or terminals are connected to opposing ends of the fusible element for facilitating electrical connection of the fuse within a circuit. Upon the occurrence of an overcurrent condition in the fuse, the fusible element melts or otherwise opens to interrupt the flow of electrical current through the fuse.

When the fusible element of a fuse is melted during an overcurrent condition it is sometimes possible for an electrical arc to propagate between the separated portions of the fusible element (e.g., through vaporized particulate of the melted fusible element). The electrical arc may rapidly heat the surrounding air and ambient particulate and may cause a small explosion within the fuse. In some cases, the explosion may rupture the fuse body, potentially causing damage to surrounding components. The likelihood of rupture is generally proportional to the severity of the overcurrent condition. The maximum current that a fuse can arrest without rupturing is referred to as the fuse's "breaking capacity." It is generally desirable to maximize the breaking capacity of a fuse without significantly increasing the cost, size, or form factor of the fuse.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a high breaking capacity fuse in accordance with the present disclosure may include an electrically insulating fuse body, a fusible element extending through the fuse body, an electrically conductive first terminal connected to a first end of the fusible element, and an electrically conductive second terminal connected to a second end of the fusible element. The high breaking capacity fuse may further include a fire extinguishing pad disposed within the fuse body adjacent the fusible element, the fire extinguishing pad formed of a polymeric substrate and a plurality of microcapsules embedded in the polymeric substrate, the plurality of microcapsules filled with an arc-quenching liquid.

Another exemplary embodiment of a high breaking capacity fuse in accordance with the present disclosure may include an electrically insulating fuse body, a fusible element extending through the fuse body, an electrically conductive first terminal connected to a first end of the fusible element, and an electrically conductive second terminal connected to a second end of the fusible element. The high breaking capacity fuse may further include a first fire extinguishing pad and a second fire extinguishing disposed within the fuse body and sandwiching the fusible element therebetween, each of the first and second fire extinguishing pads formed of a polymeric substrate and a plurality of microcapsules embedded in the polymeric substrate, the plurality of microcapsules filled with an arc-quenching liquid.

Figure 1A:
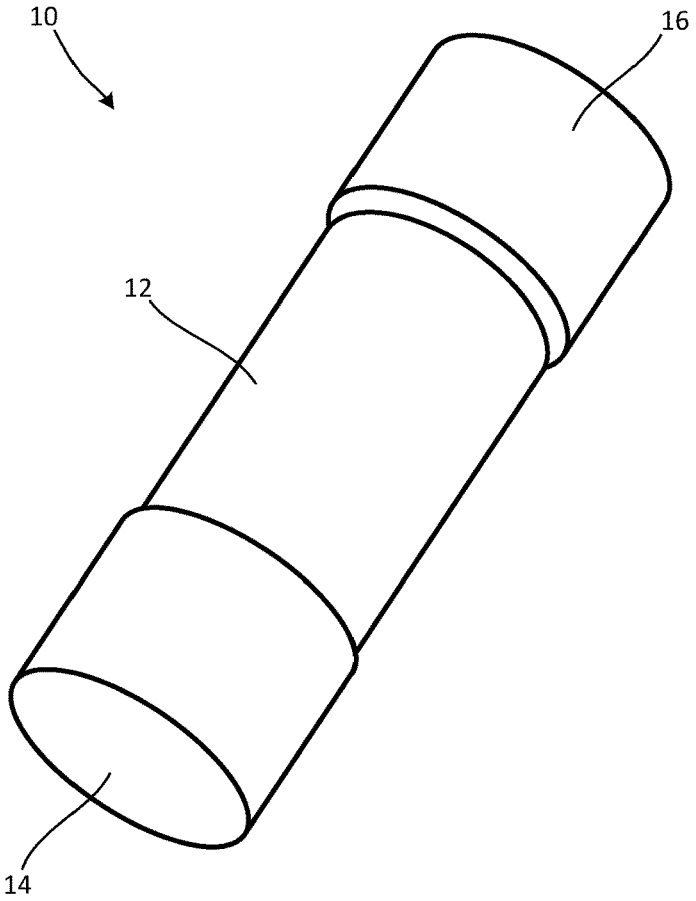
FIG. 1A is an perspective view illustrating an high breaking capacity fuse in accordance with an exemplary embodiment of the present disclosure.

The drawings are not necessarily to scale. The drawings are merely representations, not intended to portray specific parameters of the disclosure. The drawings are intended to depict example embodiments of the disclosure, and thus are not to be considered as limiting in scope. In the drawings, like numbering represents like elements.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

Embodiments of a high breaking capacity fuse in accordance with the present disclosure will now be described more fully with reference to the accompanying drawings, in which preferred embodiments of the present disclosure are presented. The high breaking capacity fuse of the present disclosure may, however, be embodied in many different forms and should not be construed as being limited to the embodiments set forth herein. Rather, these embodiments are provided so that this disclosure will be thorough and complete, and will fully convey the scope of the high breaking capacity fuse to those skilled in the art. In the drawings, like numbers refer to like elements throughout unless otherwise noted.

Figure 1B:
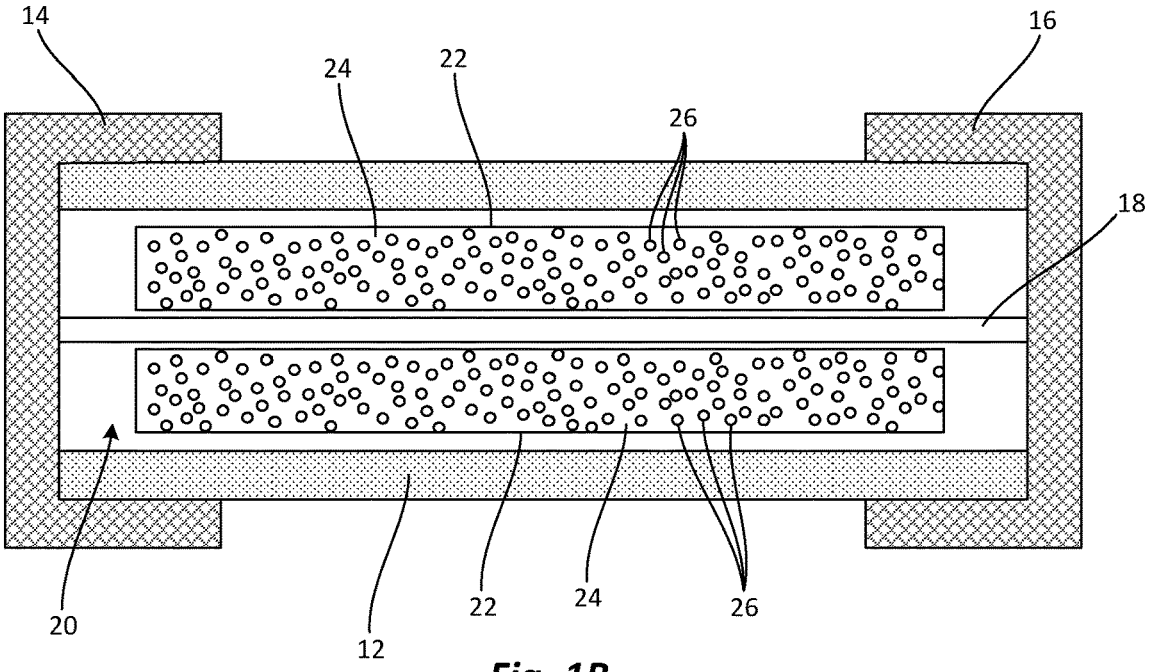
FIG. 1B is a cross-sectional view illustrating the high breaking capacity fuse of FIG. 1A.

Referring to FIGS. 1A and 1B, an isometric view and a cross-sectional view illustrating a high breaking capacity fuse 10 (hereinafter "the fuse 10") in accordance with an exemplary embodiment of the present disclosure are shown, respectively. The fuse 10 may be a cartridge fuse having a tubular fuse body 12 formed of an electrically insulating material. The present disclosure is not limited in this regard. In various alternative embodiments, the fuse 10 may be a surface mount fuse, a through hole fuse, or another type of fuse having a fusible element extending through a generally hollow fuse body. The fuse body 12 may be a round cylinder as shown in FIG. 1A, but this is not critical. Alternative embodiments of the fuse 10 may include a fuse body having a variety of different form factors (e.g., a square cylinder etc.). The present disclosure is not limited in this regard. The fuse body 12 may be formed of an electrically insulating and preferably heat resistant material, including, but not limited to, ceramic, glass, plastic, etc.

Electrically conductive first and second terminals 14, 16 may be disposed on opposing ends of the fuse body 12. The first and second terminals 14, 16 may be formed of an electrically conductive material, including, but not limited to, copper or one of its alloys, and may be plated with nickel or other conductive, corrosion resistant coatings. A fusible element 18 may extend through the hollow interior 20 of the fuse body 12 and may be connected to the first and second terminals 14, 16 in electrical communication therewith, such as by solder (not shown). The fusible element 18 may be formed of an electrically conductive material, including, but not limited to, tin or copper, and may be configured to melt and separate upon the occurrence of a predetermined fault condition, such as an overcurrent condition in which an amount of current exceeding a predefined maximum current flows through the fusible element 18. The fusible element 18 may be any type of fusible element suitable for a desired application, including, but not limited to, a fuse wire, a corrugated strip, a fuse wire wound about an insulating core, etc. The present disclosure is not limited in this regard.

The fuse 10 may further include one or more fire extinguishing pads 22 disposed within the hollow interior 20 of the fuse body 12. The fire extinguishing pads 22 may be located adjacent to, and/or may surround, the fusible element 18. For example, as shown in FIG. 1B, the fuse 10 may include first and second fire extinguishing pads 22 sandwiching the fusible element 18 therebetween. In various alternative embodiments, the fuse 10 may include only a single fire extinguishing pad folded or rolled around the fusible element 18. The present disclosure is not limited in this regard.

The fire extinguishing pads 22 may be formed of a polymeric substrate 24 having microcapsules 26 embedded therein. The microcapsules 26 may be generally spherical particles measuring about 1 millimeter or less in their largest dimension (e.g., diameter). The microcapsules 26 may be made from a petrochemical plastic such as polyethylene, polypropylene, or polystyrene, or other similar materials that are selected to rupture, melt, or otherwise break down when subjected to heat and/or pressure upon the occurrence of an overcurrent condition in the fuse 10. The microcapsules 26 may be filled with an arc-quenching liquid, such as a fluorinated ketone, e.g., NOVEC 1230 ($C_6F_{12}O$) sold by 3M. Other suitable, commercially available arc-quenching liquids include NOVEC 7500 ($C_9H_5F_{15}O$), NOVEC FC-43 ($C_8H_4F_3NO_2S$), NOVEC FC-40 ($C_{10}HF_{22}N$), and NOVEC FC-70 ($C_{15}F_{33}N$), all sold by 3M. The present disclosure is not limited in this regard.

Upon the occurrence of an overcurrent condition in the fuse 10, the fusible element 18 may melt and separate, during which heat and pressure may increase within the fuse body 12. This increase in heat and pressure may burn, melt, or otherwise breakdown the polymeric substrates 24 and microcapsules 26 embedded therein, allowing the arc-quenching liquid within the microcapsules 26 to be released. The arc-quenching liquid may rapidly draw heat away from the separated ends of the fusible element 18 and any electrical arc spanning therebetween, thereby quenching the electrical arc and preventing or mitigating rupture of the fuse body 12. Thus, the fire extinguishing pads 22 effectively increase the breaking capacity of the fuse 10, and damage that might otherwise be caused to components surrounding or connected to the fuse 10 during an overcurrent condition is mitigated or entirely prevented.

The fuse 10 of the present provides numerous advantages in the art. For example, it has been demonstrated through testing that implementing the fire extinguishing pads 22 in the manner described above significantly increases the breaking capacity of a fuse without significantly increasing the cost, size, or form factor of a fuse. Moreover, the fire extinguishing pads 22 are much lighter than traditional fuse filler materials such as sand. Still further the fire extinguishing pads 22 can be installed in a fuse (e.g., by cutting the pads to size and inserting them into a fuse body) much more easily and with relatively little mess compared to granular fuse fillers, such as sand, which are prone to spillage.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A high breaking capacity fuse comprising:
- an electrically insulating fuse body;
- a fusible element extending through the fuse body;
- an electrically conductive first terminal connected to a first end of the fusible element;
- an electrically conductive second terminal connected to a second end of the fusible element; and
- a fire extinguishing pad disposed within the fuse body adjacent the fusible element, the fire extinguishing pad comprising:
  - a polymeric substrate; and
  - a plurality of microcapsules embedded in the polymeric substrate, the plurality of microcapsules filled with an arc-quenching liquid.

2. The high breaking capacity fuse of claim 1, wherein the arc-quenching liquid is a fluorinated ketone.

3. The high breaking capacity fuse of claim 1, wherein the arc-quenching liquid is one of $C_6F_{12}O$, $C_9H_5F_{15}O$, $C_8H_4F_3NO_2S$, $C_{10}HF_{22}N$, and $C_{15}F_{33}N$.

4. The high breaking capacity fuse of claim 1, wherein the microcapsules are formed of one of polyethylene, polypropylene, and polystyrene.

5. The high breaking capacity fuse of claim 1, wherein the fire extinguishing pad is wrapped around the fusible element.

6. The high breaking capacity fuse of claim 1, wherein the fire extinguishing pad is a first fire extinguishing pad, the high breaking capacity fuse further comprising a second fire extinguishing pad disposed within the fuse body, wherein the fusible element is sandwiched between the first fire extinguishing pad and the second fire extinguishing pad.

7. The high breaking capacity fuse of claim 1, wherein the polymeric substrate is adapted to breakdown and the microcapsules are adapted to rupture upon melting of the fusible element.

8. A high breaking capacity fuse comprising:
- an electrically insulating fuse body;
- a fusible element extending through the fuse body;
- an electrically conductive first terminal connected to a first end of the fusible element;
- an electrically conductive second terminal connected to a second end of the fusible element; and
- a first fire extinguishing pad and a second fire extinguishing disposed within the fuse body and sandwiching the fusible element therebetween, each of the first and second fire extinguishing pads comprising:

a polymeric substrate; and a plurality of microcapsules embedded in the polymeric substrate, the plurality of microcapsules filled with an arc-quenching liquid.

9. The high breaking capacity fuse of claim 8, wherein the arc-quenching liquid is a fluorinated ketone.

10. The high breaking capacity fuse of claim 8, wherein the arc-quenching liquid is one of $C_6F_{12}O$, $C_9H_5F_{15}O$, $C_8H_4F_3NO_2S$, $C_{10}HF_{22}N$, and $C_{15}F_{33}N$.

11. The high breaking capacity fuse of claim 8, wherein the microcapsules are formed of one of polyethylene, polypropylene, and polystyrene.

12. The high breaking capacity fuse of claim 8, wherein the polymeric substrates of the first and second fire extinguishing pads are adapted to breakdown and the microcapsules are adapted to rupture upon melting of the fusible element.

* * * * *